US006122878A

United States Patent [19]

Pliley

[11] Patent Number: 6,122,878

[45] Date of Patent: Sep. 26, 2000

[54] SEAMLESS SIDING SYSTEM AND METHOD

[76] Inventor: Robert Pliley, Box 33, Ventura, Iowa 50482

[21] Appl. No.: 09/296,914

[22] Filed: Apr. 22, 1999

[51] Int. Cl.[7] ..... E04D 1/00

[52] U.S. Cl. ..... 52/528; 52/631; 52/746.1; 52/748.1

[58] Field of Search ..... 52/518, 528, 534, 52/545, 748.1, 746.1, 631

[56] References Cited

U.S. PATENT DOCUMENTS

| | | | |
|---|---|---|---|
| 1,100,955 | 6/1914 | Coburn | 52/518 X |
| 1,596,272 | 8/1926 | Jordan | 52/545 X |
| 1,664,261 | 3/1928 | Mullins et al. | 52/528 |
| 2,013,330 | 9/1935 | Abraham | 52/528 X |
| 2,134,034 | 10/1938 | Doe | 52/528 X |
| 2,273,485 | 2/1942 | George | 52/518 X |
| 2,402,731 | 6/1946 | Clements | 52/545 |
| 4,020,666 | 5/1977 | Beymer | 72/177 |
| 4,206,625 | 6/1980 | Vegh | 72/181 |
| 4,226,069 | 10/1980 | Hinds | 52/528 X |
| 4,660,399 | 4/1987 | Suter et al. | 72/181 |
| 4,930,287 | 6/1990 | Volk et al. | 52/748.11 |
| 5,037,685 | 8/1991 | Richards et al. | 52/518 X |
| 5,548,940 | 8/1996 | Baldock | 52/518 X |
| 5,694,728 | 12/1997 | Heath, Jr. et al. | 52/518 X |

*Primary Examiner*—Beth A. Stephan
*Assistant Examiner*—Brian E. Glessmer
*Attorney, Agent, or Firm*—Larry M. Jennings, P.A.

[57] ABSTRACT

A seamless siding made of vinyl, aluminum, or other sheet material strip is made by scoring flat material and punching fastener slots at the edges of the strip. The material is bent at the score lines to form a profile such as clap board or other desired style of siding. Fasteners through the slots hold the material to the wall while allowing the material to expand and contract in response to changing temperatures. The exposed surface may be embossed or textured as desired. The material provides a seamless siding with little waste compared to conventional wood siding products. No specialized expensive machinery, tools, or equipment is needed to carry out installation of this new siding product.

20 Claims, 5 Drawing Sheets

Fig. 8
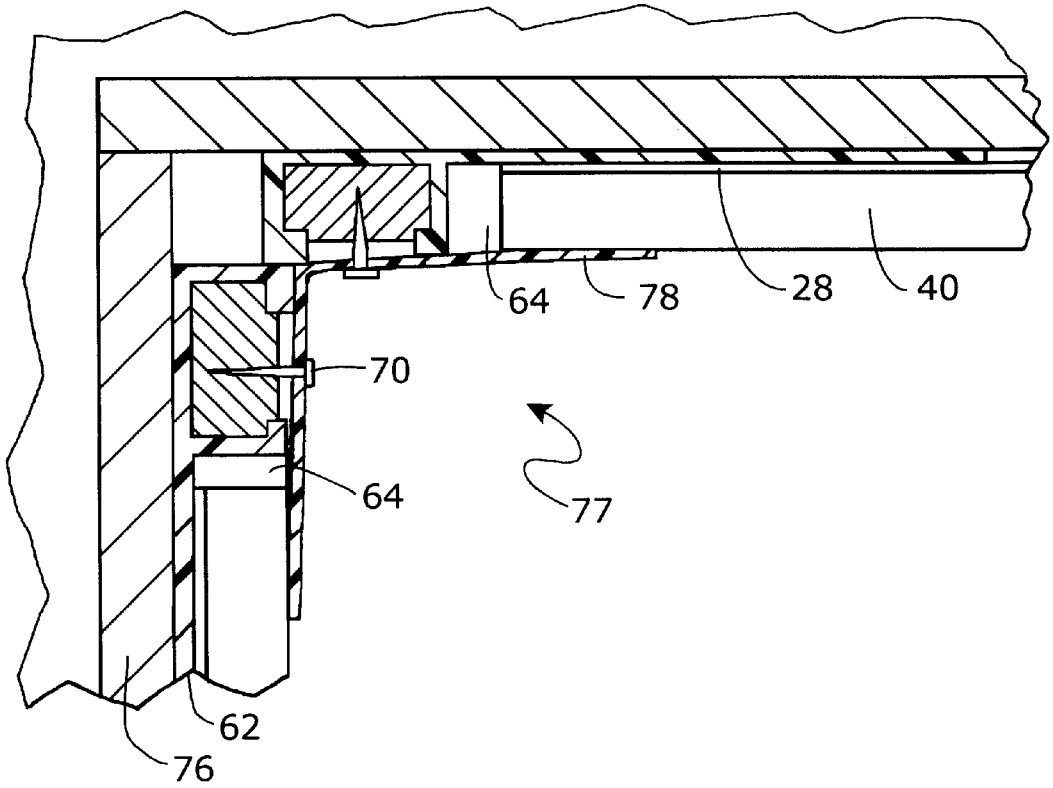
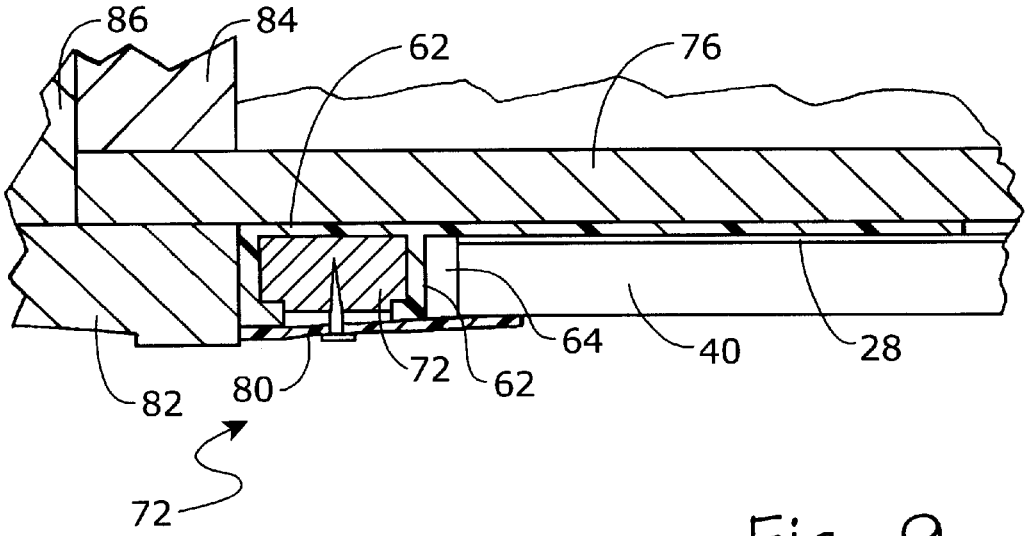
Fig. 9

SEAMLESS SIDING SYSTEM AND METHOD

TECHNICAL FIELD

The present disclosure is related to the field of building materials generally and to siding materials for exterior walls particularly. More specifically, embodiments according to the present disclosure are related to the field of seamless siding for residential and light commercial dwellings. Embodiments of the present disclosure are most closely related to the field of lap siding formed from sheet materials that can be coiled for shipping and storage and then uncoiled at the installation site.

BACKGROUND AND SUMMARY

A lap board-type of siding that can be sold in roll form in order to accommodate the need for an alternative to continuous metal siding has been unknown prior to the developments disclosed here. An alternative to continuous metal siding is needed because the cost of seamless metal siding is often prohibitive due to the fact that the required machinery is sufficiently expensive that installation is usually available only from enterprises specializing in that product.

Residential siding material choices available to individuals who have the desire and ability to do their own construction, rehabilitation, or home improvement work are unlikely to include seamless siding. The absence of a high quality, low maintenance siding material is a serious limitation in the marketplace. Retail home improvement centers enjoy increasing sales as more people find themselves involved in "do-it-yourself" projects. Persons who maintain and improve the quality of their dwellings may be rewarded by enhanced property value as well as a more appealing place to live. It also seems that improvements made to properties stimulates nearby property owners to improve additional properties. This phenomenon can lead to rehabilitation of housing in older or disadvantaged neighborhoods.

Houses in such areas are particularly in need of low-cost ways to effect genuine, lasting, improvements. Water has often damaged the siding on older houses. Sometimes there are so many coats of paint that it is quite challenging to prepare a surface for restorative painting. Some siding materials such as redwood contain oils that will cause even properly applied paint to peel from properly prepared surface after 30 to 40 years. Replacement siding boards are often quite expensive, and in some cases it is necessary to have special cutters machined so that boards can be milled to match the existing installation. Cost may prohibit repair and restoration of some moderately deteriorated dwellings, especially the larger old homes that are available in many cities and towns. Such housing can present a way for individuals and families of moderate means to substantially increase their net worth. The purchase price is often affordable, and judicious renovations can yield a pleasant home with enhanced resale value. In order for renovations of old houses to be practical, however, the operating costs must usually be reduced. Utilities costs can be reduced by insulating, reducing air infiltration, replacing furnaces, air conditioners, and other appliances with modern high-efficiency models, by using suitable landscape materials; and by reducing the amount and frequency of painting needed to keep the property in good condition and appearance.

One way to reduce the need for painting is to use siding materials such as stucco and brick that need little maintenance. Steel, aluminum, and vinyl siding also require less maintenance than do wood-based siding products. Seamless siding installation is usually restricted to specialists. Pre-formed vinyl siding for houses is currently available only in lengths of approximately 12½ feet. The fact that the availability of the material is limited to only a few styles and lengths limits the adoption of vinyl siding because the cost is increased due to waste. In addition, the fact that the available lengths are relatively short dictates that there will be joints.

End-to-end joints are both unsightly and a potential source of failure of the installation. The presence of end-to-end joints greatly increases the likelihood that water will penetrate the siding. Siding failure is virtually assured unless satisfactory provisions are made to prevent water penetration. Water that accumulates at the inside surface of a generally impermeable type of siding is difficult to remove. Rot, rust, and corrosion can quickly damage important load-bearing structural components. Chronic respiratory irritation can also be created or aggravated by molds and mildew that thrive on decaying wood, paper, and other building materials. The difficulty of water management in wall systems is compounded because siding expands and contracts in response to varying temperatures.

One common method of preventing water from penetrating siding butt joints is to fit the ends of adjacent pieces of siding into sleeves that have a cross-section that matches that of the siding. The sleeve can remain stationary while permitting the siding to withdraw when coldness contracts the material and the siding can penetrate farther when higher the material expands in response to higher temperatures. Unfortunately, dirt can accumulate in the sleeves and cause unsightly streaks on the side of the building. Even worse, siding will sometimes slip out of the sleeves, causing unsightly and damaging conditions. For that reason, it would be desirable to form the siding in continuous pieces that are cut to the needed length individually at the location where the siding is to be installed.

Several workers in the field have obtained patents directed to various vinyl siding improvements. U.S. Pat. No. 5,694,728 issued Dec. 9, 1997 to Heath et al. for a Vinyl Siding System that shows a system for interlocking imitation log siding strips together.

U.S. Pat. No. 5,548,940 issued Aug. 27, 1996 to Baldock for Rolled Vinyl Siding. The '940 patent describes a method for rolling rigid vinyl siding sheet for shipment and sale. An important difference between the Baldock method and products according to the present disclosure is that Baldock teaches a way of rolling siding that has been formed into the finished configuration. Pre-formed siding material will be unavoidably subjected to much greater stresses as it is coiled than would be flat-wound material. Pre-formed siding is also more bulky and requires spacers at the edges of the coil if the material is to be coiled straight. Without edge spacers, the coil will become conical. Not only is a conical roll more difficult to store, stack, and manage, the edge with only a single thickness of siding will be fragile, and the coil will have extra axial length. For example, if the siding of Baldock is formed in a width of 1 foot and a length of 240 feet, the coiled material may have a conical shape at the ends and extend for an axial length of 1½ to 2 feet.

A 240 foot length of vinyl siding material with edge spacers such that the thickness of the siding plus the spacer material is one inch that is coiled onto a core two feet in diameter will have a finished diameter of five feet. On the other hand, a 240 foot length siding material (approximately 1/16 inch thick) that is flat-wound onto a core two feet in diameter will have a finished diameter of about 2½ feet. A 500 foot coil would have a diameter of only 3 feet.

Another related patent of interest is U.S. Pat. No. 5,037,685 entitled Vinyl Shingle Roofing Product issued Aug. 6, 1991 to Richards, et al. The '685 patent specifies a roll of tabbed vinyl that is at least 100 feet long so that it would be possible to set an entire course of shingles on most pitched roofs with no vertical seams. Although Richards et al. do not emphasize the potential, it would appear that the roofing product could serve as siding for dwellings, also. Of course, the '685 patent makes no mention of adding the dimensionality that is an important feature of embodiments of the system according to the present disclosure.

The Volk et al. U.S. Pat. No. 4,930,287 issued Jun. 5, 1990 for Distortion-Free Vinyl Siding. The tendency of the siding to expand differentially when heated by sunlight ("oil-canning") is overcome by cutting vertical slits through the nailing strip at the top edge of each piece of siding.

A variety of machinery is presently available for forming continuous strips of steel, aluminum, or other metals into shapes adapted for building siding or roofing. None of the methods are suitable for use by a homeowner or small contractor because the cost of the machinery is too expensive to use only occasionally. What is needed is a type of siding that can be readily stored and shipped but that can also be cut to length and form for immediate installation by a homeowner or other retail customer.

Suter, et al. were issued U.S. Pat. No. 4,660,399 on Apr. 28, 1987 for their disclosure of a Mobile Roll-Forming Machine of the type used to make continuous roofing material from coiled sheet metal.

U.S. Pat. No. 4,206,625 issued Jun. 10, 1980 to Vegh for a Method and Apparatus for Shaping a Strip. The Vegh apparatus is specifically directed to forming siding and fascia from sheet metal.

Similarly, the Beymer U.S. Pat. No. 4,020,666 issued for a Mobile Forming Machine with Embossing Rolls on May 3, 1977. The machine is designed to produce siding that has a texture which resembles wood grain.

The Suter, Vegh, and Beymer patents represent the way seamless siding is currently provided. Each of their methods requires the use of a complex and expensive machine that forms coiled sheet metal to the desired shape on-site.

Baldock et al. and Richards et al. both disclose coiled vinyl materials that are not wound flat.

Vinyl has several advantages as a siding material compared to aluminum or steel. Vinyl is less likely to become dented by hail, baseballs, ladders, etc.; it will not rust or corrode; scratches and nicks do not require touch-up painting because it is the same color throughout; and vinyl is quieter.

Metal siding has a lower coefficient of expansion than vinyl or wood and can be cut to size on-site to minimize waste and clean-up cost. No painting is required for many years after the initial installation Wood and wood product siding is quieter than metal or vinyl, but is not usually available in lengths sufficient to make seamless installations. The amount of waste material generated by installation of siding made of wood products is greater than that of other types of siding because wood products are available only in fixed lengths. Painting is required periodically (usually every 3 to 5 years) to prevent deterioration.

Brick and stucco are quiet and require little maintenance but are expensive initially compared to siding made of wood products or vinyl.

Despite the efforts of earlier workers in the field, a continuous siding product that can be used by individuals, and small construction and re-modeling contractors has not been developed commercially and introduced nationally.

What is needed is an easily installed siding product that does not require painting. A product that can be vended through retail home improvement centers is needed. it is also desirable that a product that can be shipped and stored economically be provided. A further need is for a product that may be installed without the need for expensive specialized equipment. Yet another need is for a siding product that is long-lasting, durable, and easily repaired.

BRIEF DESCRIPTION OF THE INVENTION

Embodiments according to the present disclosure satisfy the foregoing and other long-felt needs for improved siding products.

Accordingly, it is an object of the invention to provide a siding system that can be installed without specialized expensive equipment.

It is another object of the invention to provide a siding system that can be installed on new or existing structures.

Another object of the invention is to provide a siding system that requires a minimum number of different components to yield a finished installation.

It is also an object of the invention to provide an integrated siding system having all needed components designed to interconnect properly for optimum performance.

Among other objects of the invention is to provide a siding system that can be shipped and stored as a flat-wound coil of sheet material that can be folded into the final shape at the time of installation.

It is another object of the invention to provide a siding system with lower initial and ongoing costs than previously known siding systems.

Another object of the invention is to provide a siding system that will enhance the appearance and value of the dwellings to which it is applied.

Yet another object of the invention is to provide a siding system that can be installed with minimal waste of material.

Articles shown in the appended drawings and described herein may be formed from elongated planar sheet material such as vinyl or aluminum. The addition of a flexible hinging component would allow stiffer materials such as steel strips to be used, also. The elongated sheet, which may be a coil or flat sheets of any length, is divided into four portions by three longitudinal score marks or hinge features. The lower edge has a row of longitudinal slots running the length of the strip. The opposite edge has two rows of slots identical to those near the lower edge. Medially adjacent, though slightly spaced-apart from, the two innermost rows of slots are two scores, or hinging features. A third score or hinge is parallel to the lower, or first, score and displaced medially about ½" (1.3 cm) to divide a lower drip edge from the exposed face of the installed product. If the product is to resemble conventional lap siding (clap-board, lap-board, lapped siding, and lap siding are deemed equivalent for the purposes of this disclosure), the lower edge is affixed uppermost and horizontally to the structure with the outside surface contacting the wall to which the siding is being applied. Once that is complete, the unattached edge is swung out from the wall and upward to put the inside surface of the top portion into contact with the wall. Nails, clips or other fasteners are installed through the topmost row of slots to affix the top edge of the siding to the wall.

The outer face of the siding hinges outwardly from the top score or hinge line. At the bottom, the drip edge holds the lower edge of the exposed surface away from the building to make a profile in the shape of a check-mark. It is to be noted that the dimensions of any of the elements can be changed to yield a deep "V" or very shallow layer offset. If, for example, the exposed surface is 4" (6 cm), the texture of the installation might be quite different if the return, or drip edge is ¼" (0.6 cm) compared to an installation where the drip edge is 1½" (3.7 cm) and the distance between successive courses of the siding is 3" (7.5 cm). In the first instance, the appearance would be quite flat and the shadows would be faint. in the second example, the shadows would be quite prominent and the surface might resemble partially opened Venetian blinds.

It would also be possible to vary the tint across the exposed surface or to add flecks of other colors or materials to achieve desired aesthetic effects. Trim elements may be made available in the same, contrasting, or complimentary colors as the siding material.

The present disclosure teaches a seamless siding system for exterior walls of buildings comprising an elongated sheet of semi-flexible planar material having a longitudinal top edge generally parallel to a bottom edge, a first end, a second end, an inside surface and an outside surface; a bottom fastener strip comprised of the portion of the sheet between the bottom edge and a first score spaced apart from, and generally parallel to, the bottom edge; a drip edge comprised of the portion of the elongated sheet between the first score and a second score spaced apart from, and generally parallel to, the first score; an exposed face comprised of the portion of the elongated sheet between the second score and a third score spaced apart from, and generally parallel to, the second score; a top fastener strip comprised of the portion of the elongated sheet between the third score and the top edge; a series of spaced-apart elongated top fastener slots formed through the top fastener strip and longitudinally aligned generally parallel to the top edge; a series of spaced-apart, elongated bottom fastener slots formed through the bottom fastener strip, located between, and aligned generally parallel to, the first score and the bottom edge; a series of spaced-apart, elongated second fastener slots may optionally be formed through the top fastener strip, located between, and aligned generally parallel to, the top fastener slots and the third score; optional siding fasteners may be adapted for fitting through the fastener slots and slidably holding the inside surface proximate the exterior wall of a building; an optional elongated termination trim may be affixed to the exterior walls of a building generally perpendicular to the longitudinal orientation of the seamless siding, and; an optional elongated corner cover is affixable to the exterior walls of a building generally parallel to the termination trim and exterior of the seamless siding and the termination trim.

BRIEF DESCRIPTION OF THE DRAWINGS

FIG. 8 is a sectional plan view detail of inside corner trim for a building fitted with an embodiment according to this disclosure.

FIG. 9 is a sectional plan view detail of opening trim for a building fitted with an embodiment according to this disclosure.

ELEMENTS WITH DRAWING REFERENCE NUMBERS

| | |
|---|---|
| 20 | siding |
| 21 | planar material (coiled) |
| 22 | first end |
| 23 | second end |
| 24 | inside surface |
| 26 | outside surface |
| 28 | top edge |
| 30 | bottom edge |
| 32 | bottom fastener strip |
| 34 | first score |
| 36 | drip edge |
| 38 | second score |
| 40 | exposed face |
| 42 | third score |
| 44 | top fastener strip |
| 46 | top fastener slot |
| 48 | second fastener slot |
| 50 | bottom fastener slot |
| 52 | v form score |
| 54 | c form score |
| 56 | siding fastener |
| 58 | outside corner termination trim |
| 60 | corner cover |
| 62 | end stop |
| 64 | expansion gap |
| 66 | cap |
| 68 | cover backer |
| 70 | cover fastener |
| 72 | fastener retaining portion |
| 74 | siding backer |
| 76 | sheathing |
| 77 | inside corner termination trim |
| 78 | inside corner cover |
| 79 | opening termination trim |
| 80 | end cover |
| 82 | opening exterior molding |
| 84 | rough opening framing |
| 86 | finished opening trim |

DETAILED DESCRIPTION OF THE INVENTION

Figure 1:
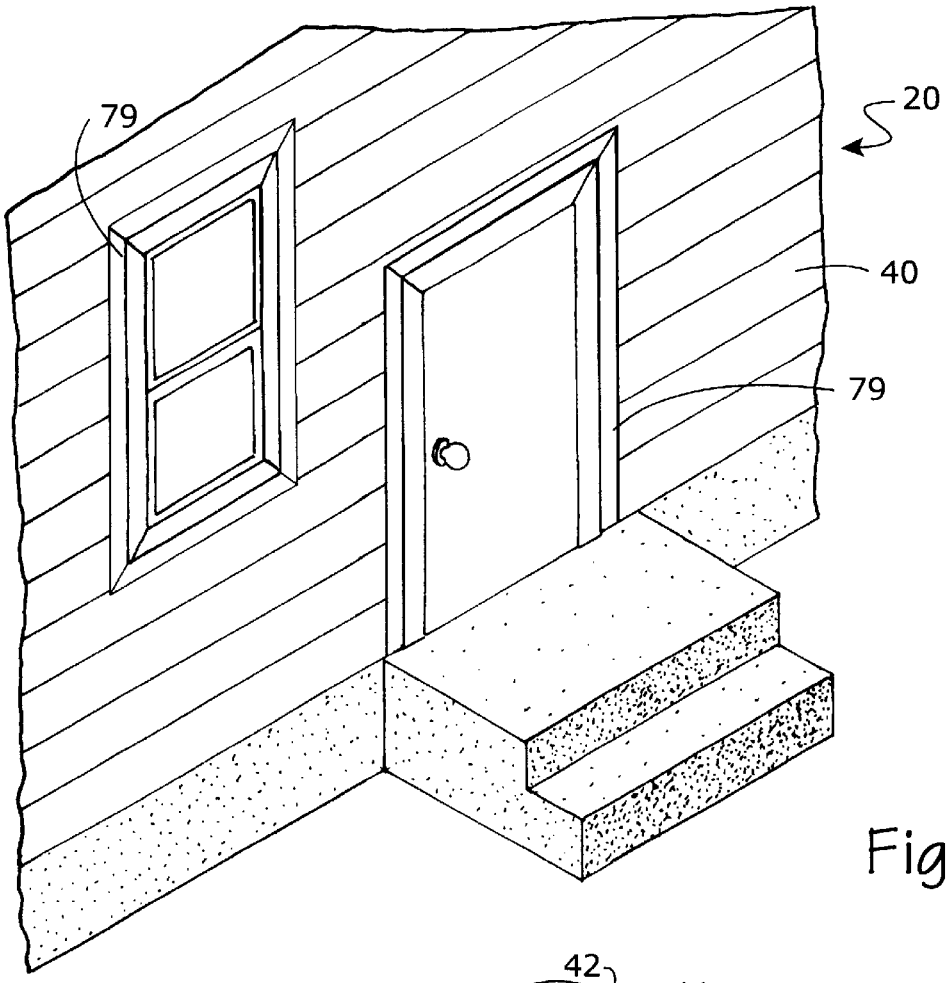
FIG. 1 shows a portion of an exterior wall of a building on which an embodiment of the invention has been installed.

Referring first to FIG. 1 there is shown an overall view of part of a building that has siding 20 made of a planar material 21 such as vinyl, polyvinyl chloride, aluminum, steel, or other planar material that can be packaged, shipped, and stored in coil form.

Figure 2:
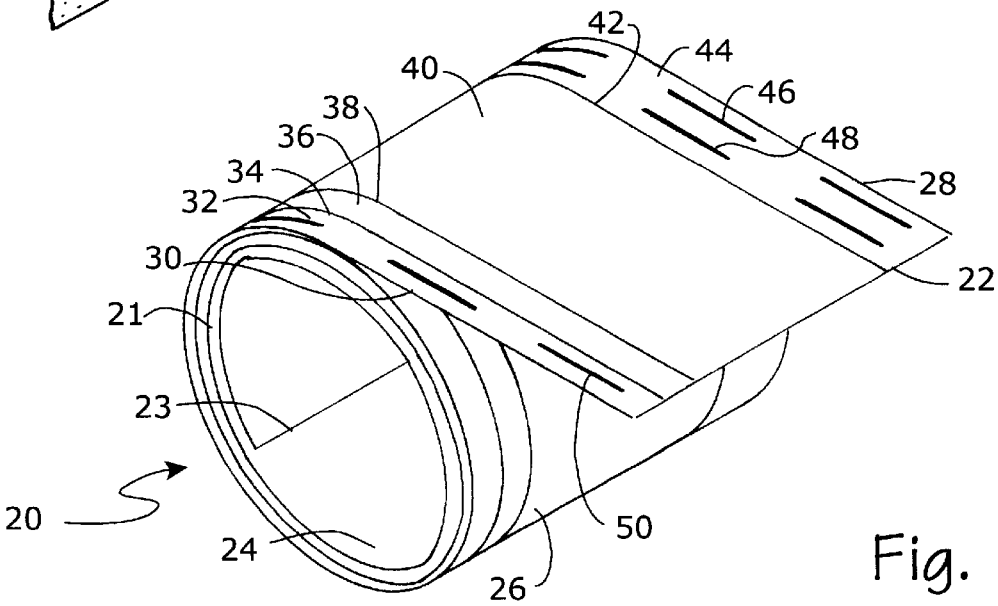
FIG. 2 is a perspective view of a coil of the siding made from planar material and which is ready for installation.

FIG. 2, depicts a coil of siding 20 having a first end 22, a second end 23, an inside surface 24, an outside surface 26, a top edge 28 and a bottom edge 30. A bottom fastener strip 32 is divided from the rest of the planar material 21 by a first score 34 that runs parallel to the bottom edge 30 for the length of the planar material 21. A drip edge 36 is formed by the material 21 adjacent to the first score 34 opposite the bottom fastener strip. A second score 38 spaced apart slightly from, and parallel to, the first score 34 separates the drip edge 36 from the exposed face 40 of the siding 20. A third score 42 runs parallel to the second score 38 to define the upper terminus of the exposed face 40. A top fastener strip 44 is formed between the third score and the top edge 28.

Both the top fastener strip 44 and the bottom fastener strip 32 are used to secure the siding 20 to a building. A series of top fastener slots 46 are formed through the planar material 21 so that the siding 20 can slide in response to thermal expansion and contraction. A series of second fastener slots 48 may also be formed through the top fastener strip 44. A single row of bottom fastener slots 50 is likely to provide adequate strength to hold the bottom portion of the siding 20, including the drip edge 36, proximate the wall of a building.

The siding 20 may be installed by affixing the outer surface 26 of the bottom fastener strip 32 against the wall of a building with the bottom edge 30 horizontal and uppermost. By folding the planar material 21 approximately 90 degrees at the first score 34 and then folding the planar material 21 slightly more than 90 degrees at the second score 38, the inside surface 24 of the top fastener strip 44 may be brought into contact with the wall of the building and affixed to it. The third score 42 defines the upper limit of the exposed surface 40. The next piece of seamless siding 20 can be installed similarly so as to overlap the first piece and thereby shed water.

The scores 34 38 42 may be formed by any desired means now known or later developed. Scoring machinery is commercially available for scoring fold lines and flaps in cardboard and corrugated shipping cartons and packaging of various types.

Figure 3:
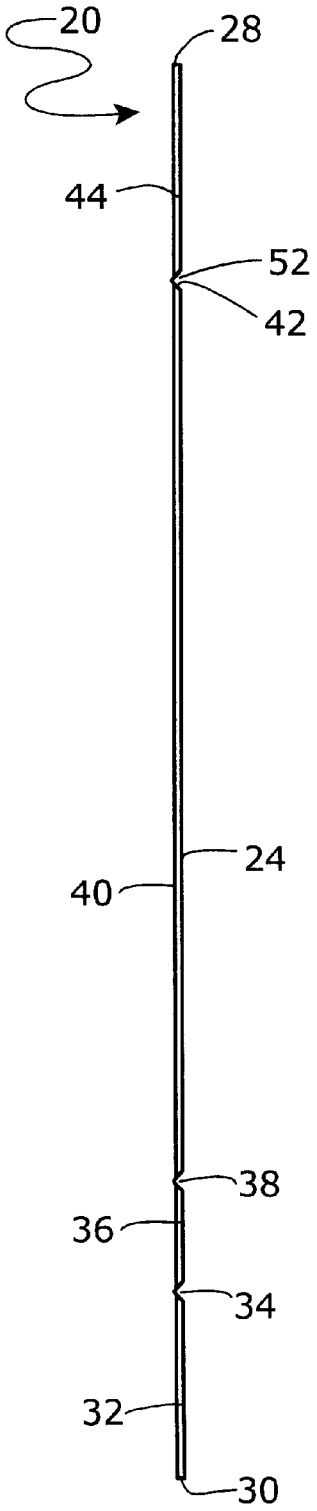
FIG. 3 is a cross-section of the siding of FIG. 1 showing v-form scores.

FIG. 3 shows that as one alternative embodiment, incised "V"-shaped scores 52 may be cut or extruded in the planar material during manufacture. The walls of the "V" may be coated with a one part or a two part adhesive to reduce flexing after the installation is complete.

Figure 4:
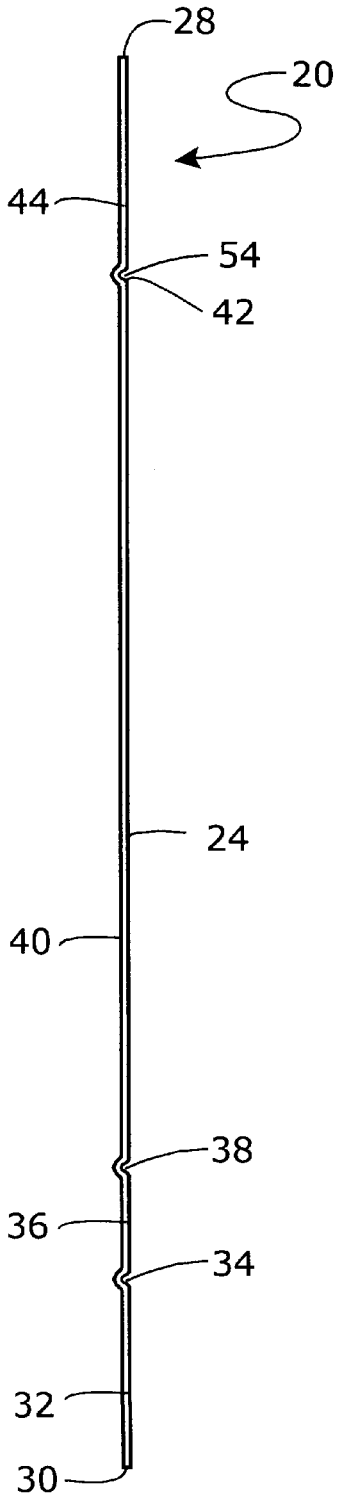
FIG. 4 is a cross-section of an alternative embodiment of the siding of FIG. 1 showing c-form scores.

FIG. 4 shows an alternative embodiment having "C"-shaped scores 24 28 and 42 that could be formed by roll scoring equipment or by extruding that shape. Other techniques may also be employed to score the planar material 21.

Figure 5:
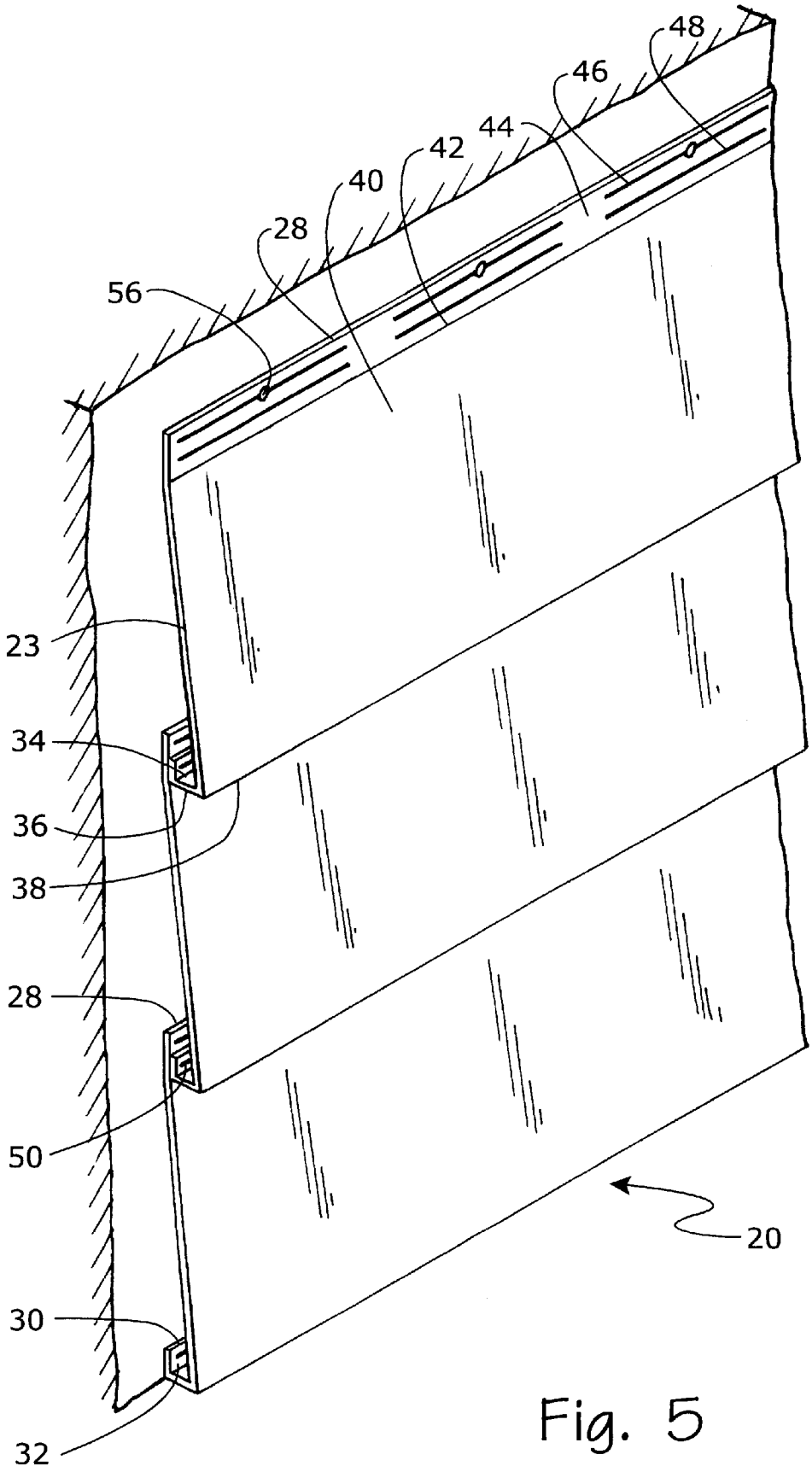
FIG. 5 is a perspective detail of a portion of the wall of FIG. 1.

FIG. 5 shows a portion of a wall to which the seamless siding has been applied. It can be seen that siding fasteners 56 may be installed through the top fastener slot 46 on one piece of seamless siding 20 so as to allow the bottom fastener slot 50 of the next piece of siding 20 to be installed to overlie the second fastener slot 48. By configuring the material 21 so that single siding fastener 56 can traverse both slots 48 50, alignment of the courses is conveniently provided, greatly simplifying installation. It is important that the siding fasteners 56 be installed so that the siding 20 can move longitudinally or the siding will buckle when it warms or else crack when the siding 20 is subjected to cold temperatures, or both. If nails are used as siding fasteners 56, they must not be driven in too far or else the siding 20 will not be able to expand and contract freely. It is possible to use fastener clips or nail-like fasteners with stops or gages to reduce the likelihood of the fasteners 56 being installed too tightly.

Figure 6:
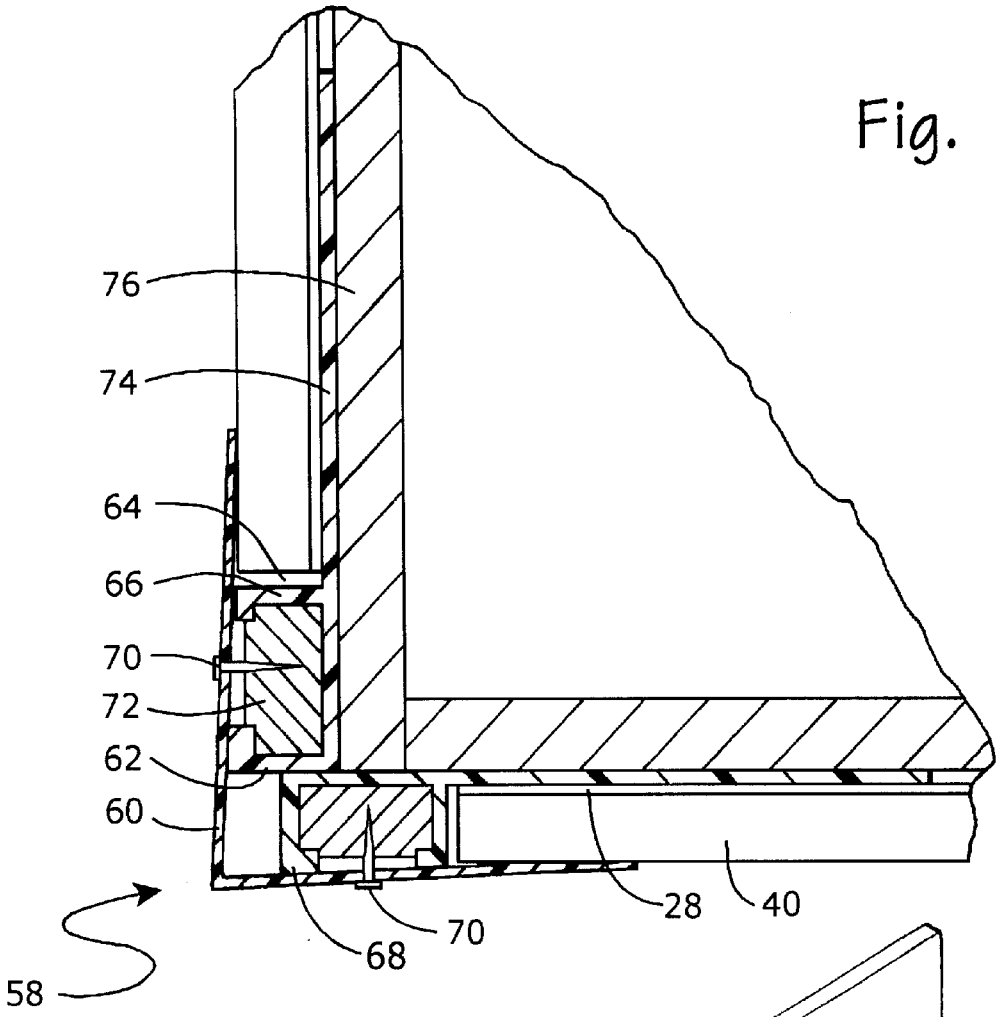
FIG. 6 is a sectional plan view detail of outside corner trim for a building fitted with an embodiment according to this disclosure.

In FIG. 6 the outside corner termination trim 58 is detailed. An exterior corner cover 60 is affixed to an end stop 62 to conceal the expansion gap 64 between the cap portion 66 and the ends of the siding 22 23.

Figure 7:
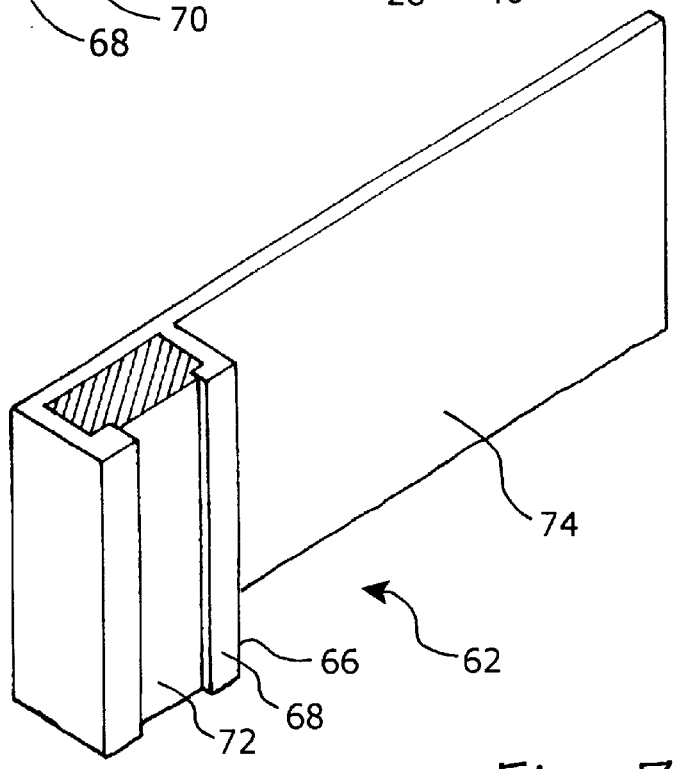
FIG. 7 is a perspective detail of a fragment of end stop material.

FIG. 7 more clearly shows the cover backer 68 edges adjacent to which the corner cover 60 is affixed by cover fasteners 70 which may be nails, screws, adhesives, or any other type of fastener. A fastener retaining portion 72 adapted for securely holding the type of fastener selected for use as the cover fastener 70.

The siding backer 74 provides a uniform surface that is spaced apart from the inner side of the corner cover 60 by the cover backer 68. The dimension of the cap 66 is equal to the thickness of the siding 20 at the drip edge 36. The siding 20 is thereby retained between the corner cover 60 and the siding backer 74. The siding backer 74 is also adapted for attaching to the exterior sheathing 76 of structural walls at corners and openings. Because the same siding backer 74 is used for three different purposes, the number of different components required to complete an installation of siding is minimized.

FIG. 8 shows an inside corner termination trim 77 detail. The same components can be used to finish both the inside corners and the outside corners of a building. Alternatively, an inside corner cover 78 may be provided that is different from the corner cover 60.

FIG. 9 shows an opening termination trim 79 that can be used to finish the siding 20 at windows and doors. An end cover 80 may be formed specifically for finishing at openings. Alternatively, the end cover 80 may be cut from corner covers 60. The end cover 80 can be attached to the siding backer 74 and held adjacent to the opening exterior molding 82 which, in turn is attached to the rough opening framing 84, as is the finished opening trim 86.

I claim:

1. A seamless siding system for exterior walls of buildings comprising:

a. an elongated sheet of semi-flexible planar material having a longitudinal top edge generally parallel to a bottom edge, a first end, a second end, an inside surface and an outside surface, b. a bottom fastener strip comprised of the portion of the sheet between the bottom edge and a first score spaced apart from, and generally parallel to, the bottom edge, c. a drip edge comprised of the portion of the elongated sheet between the first score and a second score spaced apart from, and generally parallel to, the first score, d. an exposed face comprised of the portion of the elongated sheet between the second score and a third score spaced apart from, and generally parallel to, the second score, e. a top fastener strip comprised of the portion of the elongated sheet between the third score and the top edge, f. a series of spaced-apart elongated top fastener slots formed through the top fastener strip and longitudinally aligned generally parallel to the top edge, g. a series of spaced-apart, elongated bottom fastener slots formed through the bottom fastener strip, located between, and aligned generally parallel to, the first score and the bottom edge.

2. The seamless siding system for exterior walls of buildings of claim 1 further comprising siding fasteners adapted for fitting through the fastener slots and slidably holding the inside surface proximate the exterior wall of a building.

3. The seamless siding system for exterior walls of buildings of claim 1 further comprising a series of spaced-apart, elongated second fastener slots formed through the top fastener strip, located between, and aligned generally parallel to, the top fastener slots and the third score.

4. The seamless siding system for exterior walls of buildings of claim 2 further comprising a series of spaced-apart, elongated second fastener slots formed through the top fastener strip, located between, and aligned generally parallel to, the top fastener slots and the third score.

5. The seamless siding system for exterior walls of buildings of claim 1 further comprising elongated termination trim affixable to the exterior walls of a building generally perpendicular to the longitudinal orientation of the seamless siding.

6. The seamless siding system for exterior walls of buildings of claim 2 further comprising elongated termination trim affixable to the exterior walls of a building generally perpendicular to the longitudinal orientation of the seamless siding.

7. The seamless siding system for exterior walls of buildings of claim 3 further comprising elongated termination trim affixable to the exterior walls of a building generally perpendicular to the longitudinal orientation of the seamless siding.

8. The seamless siding system for exterior walls of buildings of claim 4 further comprising elongated termination trim affixable to the exterior walls of a building generally perpendicular to the longitudinal orientation of the seamless siding.

9. The seamless siding system for exterior walls of buildings of claim 5 further comprising an elongated corner cover affixable to the exterior walls of a building generally parallel to the termination trim and exterior of the seamless siding and the termination trim.

10. The seamless siding system for exterior walls of buildings of claim 6 further comprising an elongated corner cover affixable to the exterior walls of a building generally parallel to the termination trim and exterior of the seamless siding and the termination trim.

11. The seamless siding system for exterior walls of buildings of claim 7 further comprising an elongated corner cover affixable to the exterior walls of a building generally parallel to the termination trim and exterior of the seamless siding and the termination trim.

12. The seamless siding system for exterior walls of buildings of claim 8 further comprising an elongated corner cover affixable to the exterior walls of a building generally parallel to the termination trim and exterior of the seamless siding and the termination trim.

13. A method for making continuous lapped siding for a building comprising the steps of:

a. forming an elongated planar sheet of semi-flexible material having a longitudinal top edge generally parallel to a bottom edge, a first end, a second end, an inside surface and an outside surface, b. scoring a first score spaced apart from, and generally parallel to, the bottom edge, thereby c. forming a bottom fastener strip comprised of the portion of the sheet between the bottom edge and the first score, d. scoring a second score spaced apart from, and generally parallel to, the first score, thereby, e. forming a drip edge comprised of the portion of the elongated sheet between the first score and the second score, f. scoring a third score spaced apart from, and generally parallel to, the second score, thereby, g. forming an exposed face comprised of the portion of the elongated sheet between the second score and the third score, and also h. forming a top fastener strip comprised of the portion of the elongated sheet between the third score and the top edge, i. forming a series of spaced-apart elongated top fastener slots through the top fastener strip, the elongated top fastener slots being longitudinally aligned generally parallel to the top edge, j. forming a series of spaced-apart, elongated bottom fastener slots through the bottom fastener strip, the elongated bottom fastener slots being located between, and aligned generally parallel to, the first score and the bottom edge.

14. The method of claim 13 wherein a series of spaced-apart elongated second fastener slots are formed through the top fastener strip, the elongated second fastener slots being longitudinally aligned generally parallel to and between the top fastener slots and the third score.

15. The method of claim 14 wherein the second fastener slots and the bottom fastener slots are aligned transversely.

16. The method of claim 15 wherein the planar sheet material is formed of an extruded polymer material.

17. A method for applying continuous lapped siding to a building comprising the steps of:

a. cutting to the desired length a portion of an elongated planar sheet of semi-flexible material having;

1. a longitudinal top edge generally parallel to a bottom edge, a first end, a second end, an inside surface and an outside surface,
2. a bottom fastener strip comprised of the portion of the sheet between the bottom edge and a first score spaced apart from, and generally parallel to, the bottom edge,
3. a drip edge comprised of the portion of the elongated sheet between the first score and a second score spaced apart from, and generally parallel to, the first score,
4. an exposed face comprised of the portion of the elongated sheet between the second score and a third score spaced apart from, and generally parallel to, the second score,
5. a top fastener strip comprised of the portion of the elongated sheet between the third score and the top edge,
6. a series of spaced-apart elongated top fastener slots formed through the top fastener strip and longitudinally aligned generally parallel to the top edge,
7. a series of spaced-apart elongated second fastener slots are formed through the top fastener strip, the elongated second fastener slots being in transverse alignment with the top fastener slots and longitudinally aligned generally parallel to and between the top fastener slots and the third score,
8. a series of spaced-apart, elongated bottom fastener slots formed through the bottom fastener strip, located between, and aligned generally parallel to, the first score and the bottom edge and in transverse alignment with the top fastener slots and the second fastener slots, b. disposing the bottom surface of the planar sheet uppermost with the outside surface against the wall at a desired location on the wall and aligning the bottom edge horizontal and straight, c. fastening the planar sheet material to the wall by disposing fasteners through the bottom fastener slots, d. bending the planar sheet material upwardly and outwardly away from the wall at the first score thereby bringing the drip edge to a generally horizontal orientation, e. bending the planar sheet material upwardly and inwardly toward the wall at the second score thereby bringing the exposed surface generally vertical, f. bending the top fastener strip slightly toward the exposed surface at the third score, g. disposing the top fastener strip against the wall horizontally h. fastening the top fastener strip to the wall by disposing fasteners through the top fastener slots, i. cutting to the desired length a portion of an elongated planar sheet of semi-flexible material, j. disposing the bottom edge of the planar sheet uppermost with the outside surface against the previously installed piece of planar sheet material and aligning the bottom fastener slots with the second fastener slots of the previously installed piece of planar sheet material, k. fastening the planar sheet material to the wall by disposing fasteners through the aligned bottom fastener slots and second fastener slots, l. repeating steps d. through k. until the desired coverage of the wall with siding is achieved.

18. The method of claim 17 wherein the planar sheet material is extruded polymer material.

19. The method of claim 17 wherein the planar sheet material is vinyl.

20. The method of claim 17 wherein the planar sheet material is aluminum.

* * * * *